US007387564B2

(12) United States Patent
Jespersen

(10) Patent No.: US 7,387,564 B2
(45) Date of Patent: Jun. 17, 2008

(54) GRINDING APPARATUS

(75) Inventor: Poul Erik Jespersen, Roslev (DK)

(73) Assignee: Flex Trim A/S, Roslev (DK)

( * ) Notice: Subject to any disclaimer, the term of this patent is extended or adjusted under 35 U.S.C. 154(b) by 0 days.

(21) Appl. No.: 10/581,957

(22) PCT Filed: Dec. 8, 2004

(86) PCT No.: PCT/DK2004/000848

§ 371 (c)(1),
(2), (4) Date: Sep. 20, 2006

(87) PCT Pub. No.: WO2005/053902

PCT Pub. Date: Jun. 16, 2005

(65) Prior Publication Data

US 2007/0141953 A1 Jun. 21, 2007

(30) Foreign Application Priority Data

Dec. 8, 2003 (DK) ..... 2003 01806
Sep. 24, 2004 (DK) ..... 2004 01457

(51) Int. Cl.
*B24B 23/00* (2006.01)

(52) U.S. Cl. ..... 451/354; 451/353; 451/456

(58) Field of Classification Search ..... 451/350–354, 451/451–457

See application file for complete search history.

(56) References Cited

U.S. PATENT DOCUMENTS 3,673,744 A * 7/1972 Oimoen ..... 451/353
3,722,147 A 3/1973 Brenner
3,935,678 A * 2/1976 Marton ..... 451/359
3,987,589 A * 10/1976 Marton ..... 451/359
4,135,334 A 1/1979 Rudiger
4,688,289 A 8/1987 Urakami
4,782,632 A 11/1988 Matechuk
4,839,995 A * 6/1989 Hutchins ..... 451/357
4,939,872 A 7/1990 Revelin et al.
5,713,785 A * 2/1998 Nishio ..... 451/451
5,908,224 A 6/1999 Santos (Continued)

FOREIGN PATENT DOCUMENTS

CH 666648 8/1988

(Continued)

*Primary Examiner*—Dung Van Nguyen
(74) *Attorney, Agent, or Firm*—James Creighton Wray; Clifford D. Hyra

(57) ABSTRACT

The present invention concerns a grinding apparatus (1) including a number of grinding units (3), a number of drive units (11) and a number of screen units (2), where a number of the grinding units (3) are enclosed by at least one of the screen units (2), and where at least one the screen units (2) is arranged with a pipe connection (4) adapted for connecting one or more suction units (21), where the screen unit (2) with the pipe connection (4) is designed along a lower edge (6) with a number of spacer members (7) that are arranged adjustable and replaceable, and a number of sealing members (8) that fit tightly to an underlying surface, that the spacer members (7) establish an adjustment of spacing of the grinding units (3) relatively to an underlying surface, and that the sealing members (8) interact with the suction units (21) for forming a vacuum that holds the grinding apparatus (1) against the said surface during operation.

11 Claims, 6 Drawing Sheets

U.S. PATENT DOCUMENTS

| | | | | |
|---|---|---|---|---|
| 6,027,399 | A | 2/2000 | Stewart | |
| 6,053,806 | A * | 4/2000 | Ohlendorf | 451/456 |
| 2003/0033684 | A1 | 2/2003 | Konrad | |
| 2003/0119435 | A1 | 6/2003 | Ohlendorf | |

FOREIGN PATENT DOCUMENTS

| | | |
|---|---|---|
| CH | 681776 | 5/1993 |
| DE | 20315366 | 1/2004 |
| EP | 0286051 | 10/1988 |
| GB | 489132 | 7/1938 |
| WO | WO 97/32692 | 9/1997 |
| WO | WO 03/076131 | 9/2003 |

* cited by examiner

GRINDING APPARATUS

This application claims the benefit of Danish Application No. PA 2003 01806 filed Dec. 8, 2003, Danish Application No. PA 2004 01457 filed Sep. 24, 2004 and PCT/DK2004/000848 filed Dec. 8, 2004, which are hereby incorporated by reference in their entirety.

FIELD OF THE INVENTION

The present invention concerns a grinding apparatus including a number of grinding units, a number of drive units and a number of screen units, where a number of the grinding units are enclosed by at least one of the screen units, and where at least one of the screen units is arranged with a pipe connection adapted for connecting one or more suction units.

BACKGROUND OF THE INVENTION

When grinding large surfaces, such as the hull of a ship, windmill wings or large tower elements, presently handheld grinding apparatuses are used which are moved back and forth on the surface to be ground.

The person using the grinding apparatus is usually to walk with respiratory protection and safety goggles for protecting himself against the abraded material whirled into the air while using the grinding apparatus.

In the coming years, there will be proposed regulation in Denmark where the use of grinding apparatuses in the outdoors without possibility of collecting the abraded material will either become banned, or very restrictive rules will be set up.

This implies that it will be necessary to grind the items either indoor in a controlled environment, or to provide grinding apparatuses with screening from which the abraded material may be removed.

It will be a great disadvantage if one is obliged to grind everything indoors, since it will imply large costs for establishing workshops that are large enough for e.g. tower elements, ships and the like to be indoor during the grinding process. Furthermore, it may entail large transportation costs in cases where the element to be ground is to be transported to a grinding workshop.

Another problem with grinding large elements or grinding high-level surfaces is that it may be difficult to stand on the ground and guide the grinding apparatus manually. I.e. scaffolding is to be used in order to grind the surface of the elements safely. A solution to this problem is to mount the grinding apparatus on a longitudinally adjustable handle whereby it is possible to reach the top of the element.

The disadvantage of a longitudinally adjustable handle in connection with a commonly known grinding apparatus for grinding approximately vertical surfaces is that it is difficult to apply correct pressure on the grinding disc for ensuring efficient grinding, and that the handle is to have a certain dimension for withstanding the weight of the grinding apparatus. This implies a cumbersome handling of the grinding apparatus and risk of bad surface grinding.

CH-A5-666 648 discloses a handheld grinding apparatus that includes two grinding units, a drive unit and a, screen member, where the two grinding units are enclosed by the screen unit which is arranged with a pipe connection for connecting a suction unit.

The spacer member, which is provided along a lower edge on the screen unit, only has one function, namely to prevent abraded material from being spread to the surroundings, as abraded material spread to the surroundings can be sucked out via the pipe connection.

The disadvantage of this grinding apparatus is that:

- the grinding apparatus under use is to be pressed down against a surface, and the applied pressure is to be maintained manually for continuous grinding of the surface. This entails that the operator is to use effort in pressing the grinding apparatus against the surface and to move the grinding apparatus across the surface.
- the spacer member, which is adjustable in height and rubber elastic, is deformed by applied pressure and thus only has a sealing function. Applied pressure may, however, also entail that the engagement between the grooves of the spacer member and the lower edge of the screen unit is released, after which the spacer element is pressed upwards onto the lower edge of the screen unit. This results in that the spacer member looses its sealing function, unless the operator is applied further pressure, which may be a drawback as the effect of the grinding is increased thereby.

PURPOSE OF THE INVENTION

It is therefore the purpose of the present invention to indicate a grinding apparatus which is easy to handle and which by means of a suction unit forms a vacuum in at least one of the screen units of the grinding apparatus, so that the entire grinding apparatus is self-attaching on vertical and horizontal surfaces during operation.

This is achieved with a grinding apparatus of the kind specified in preamble of claim 1, and where the screen unit with the pipe connection is designed along a lower edge with a number of spacer members that are arranged adjustable and replaceable, and with a number of sealing members that fit tightly to an underlying surface, that the spacer members establish an spacing adjustment of the grinding units relatively to an underlying surface, and that the sealing members interact with the suction units for forming a vacuum that holds the grinding apparatus against the said surface during operation.

DESCRIPTION OF THE INVENTION

With a self-attached grinding apparatus it is possible to reach the entire surface of large elements or highly elevated surfaces, since it is possible to attach the apparatus at normal reaching level and subsequently to move it up along the surface of the element, e.g. with a handle or by means of integrated moving motors.

In order produce a grinding apparatus which is easy to handle, and which ensures an efficient surface grinding irrespectively whether the surface is vertical or horizontal, the grinding apparatus includes a number of grinding units, a number of drive units and a number of screen units, where a number of the grinding units are enclosed by at least one of the screen units.

In order to provide a self-attaching grinding apparatus, at least one of the screen units are arranged with a pipe connection which is adapted for connecting to one or more suction units that form vacuum in the screen units, the vacuum holding the grinding apparatus against the surface during operation.

In order to ensure maintenance of the vacuum in the screen unit, the screen unit with the pipe connection along a lower edge includes a number of adjustable and replaceable spacer members and a number of sealing members.

The sealing members provide for the screen unit fitting tightly against the surface and so that unnecessary false air does not enter the screen unit during operation, so that the vacuum can be maintained with a minimum of suction from the suction unit.

These sealing members may e.g. be Teflon® skirts that are connected either along the lower edge of the screen or in connection with the spacer members.

In an embodiment of the present invention, these Teflon® skirts are made so that they have a top tie so that they by applying the screen unit to a surface will crease a little upwards and outwards, whereby a part of the Teflon® skirts will always bear down against the surface. This entails that there is a tight interface between the screen unit and the surface.

Sealing members may, however, be of other types, such as e.g. rubber mouldings or an enclosing collar member of e.g. flexible plastic/rubber providing tight fit between the screen unit and the surface.

In this way, the grinding apparatus may be placed on a ceiling surface or a vertical surface without falling down, or without using force for holding the grinding apparatus in place.

The adjustable and replaceable spacer members enable an adjustment of the spacing of the grinding units in relation to the surface, entailing that it is possible to control the grinding efficiency and/or to move the grinding apparatus across a surface without grinding the surface.

The spacer members may e.g. be brushes that provide for the screen unit to be moved around on the surface without leaving any marks, and which furthermore implies easy dragging of the screen unit across the surface. The brushes will furthermore cause the abraded material to be kept inside the screen unit before being sucked away, and it will therefore not disappear out under the edge of the screen unit.

In an embodiment of present invention, the screen unit with the pipe connection encloses a number of the grinding units. I.e. the screen unit contains one or more rotating grinding units, and the vacuum provides for holding the grinding apparatus against the surface and simultaneously provides for removing abraded material.

By controlling the direction of rotation of the grinding unit, it will be possible to control the travel of the grinding apparatus across the surface whereby the grinding apparatus, besides being self-attaching, will also be self-propelled. This means that one may stand on the ground and control the surface grinding, e.g. with a remote control.

In a second embodiment of the present invention, the screen unit with the pipe connection is connected to satellite screen units that each enclose a number of the grinding units.

This means that a central screen unit is provided, for example, to which the suction unit is connected and a number of satellite screen unit enclosing a number of grinding units, and where it is the central screen unit that provides for the grinding apparatus being held firmly against the surface while the surface grinding occurs in the connected satellite screen units.

In order to ensure that abraded material is removed from the screen unit with grinding units, these are preferably connected with the suction unit, however, without creating so much vacuum in the screen units that they are hold fast to the surface.

The adjustable spacer members and the sealing members enable moving the grinding apparatus without any problems across the surface, entailing that no great force is to be applied for moving the grinding apparatus. This is a great advantage if the grinding apparatus is suspended at great height on an element and is to be controlled by means of a handle.

In order to further facilitate the movement of the grinding apparatus across a surface, each of the screen units includes a number of wheels. This may be applicable if grinding is only to be performed spotwise on the surface and the grinding apparatus is to be moved a distance before reaching the next grinding spot. Furthermore, wheels will also be an advantage if the grinding apparatus is to pass an uneven surface.

In an embodiment of the present invention, the screen units are articulated connected with a number of linking rods, entailing that the grinding apparatus can be used for grinding one or more laterally disposed surfaces with different inclination. This may be particularly applicable when grinding corners or edges.

In an embodiment of the present invention, the screen units include two screens that are arranged preferably coaxially. This implies that the grinding apparatus may be used together with e.g. water so that the grinding units and the water is kept within the inner screen, while the suction unit produces vacuum in the interspace between the inner screen and the outer screen, so that the grinding apparatus can be held fast to the surface.

In order to avoid moving around with the grinding apparatus and thus assuming awkward working positions, the screen unit is adapted so that it is connected with a longitudinally adjustable handle. This entails that one may stand upright and polish a surface so that a ceiling surface or a side face may be reached by means of the handle without having to move or to get down on the knees.

A screen unit connected with a handle can be used like a broom, so that one may stand over a lying surface and move the grinding apparatus back and forth across the surface.

As alternative to using a longitudinally adjustable handle, the grinding apparatus may be provided with a number of motors for movement and which may be remotely controlled.

The grinding apparatus may be used for different types of grinding units that may be designed as circular grinding wheels, cylindric grinding rollers and/or polygonal grinding plates.

In a preferred embodiment of the invention, the grinding units are circular grinding wheels disposed in the screen unit so that the face of the grinding wheel is parallel with the surface. When the grinding wheel is brought in contact with the surface, the rotation of the grinding wheel will provide a surface treatment which is a circular grinding.

In an alternative version of the invention, the grinding units will be cylindric grinding rollers disposed so that their axes of rotation are approximately parallel with the surface. When the grinding wheel is brought in contact with the surface, the rotation of the grinding roller will provide a surface treatment which is a linear grinding.

In a second alternative embodiment, the grinding units may be polygonal grinding plates disposed in the screen unit so that the face of the grinding plate is parallel with the surface, and instead of rotating movement, the grinding plate has a cyclic movement back and forth.

In all three above mentioned types of grinding units it will be possible to use different types of grinding members. These grinding members may e.g. be polishing cloth, sandpaper, brushes, steel brushes, wire brushes or similar, which by moving across a surface will provide grinding/polishing of the surface.

In order to use the different types of grinding members on the grinding units, these are replaceable and adjustable in height.

It is thereby possible to adjust the height of the grinding units in relation to e.g. the grinding member applied, so that the exact grinding effect desired is attained on the surface.

The grinding units are replaceable, i.e. they may be exchanged quickly and easily. It is thus possible to use the same grinding apparatus/grinding units for rough grinding, fine grinding or finishing a surface.

In order to ensure vacuum in the screen unit and to provide for removal for the abraded material, the screen units are adapted with pipe connections for connecting suction units. These suction units are e.g. a vacuum pump, a suction cleaner and/or fans.

In an embodiment of the present invention, the suction unit is a vacuum pump which is placed stationarily in the area in which the screen unit is wanted to be used, and it is connected to the screen unit via e.g. hoses, whereby the grinding apparatus is held onto the surface and the abraded material is sucked into a container for storage until disposal of the abraded material.

In a second embodiment of the present invention, the suction unit is a suction cleaner which may be portable or mobile, which then may be carried around the item to be ground. In a third embodiment of the present invention, the suction unit is a suction cleaner mounted directly on the grinding apparatus.

In a fourth embodiment of the present invention, the suction units may be fans which by means of a ventilator forms a subpressure/vacuum in the screen units, whereby the grinding apparatus is held onto the surface and the abraded material is removed.

In order to avoid whirling abraded material out into the air by using the grinding apparatus, presenting a hazard for persons standing in the vicinity, the grinding apparatus is designed with a number of screen units with at least one pipe connection for connecting one or more suction units that may form a vacuum in the screen unit and suck the abraded material via the pipe connection out from the screen unit and on to e.g. a collecting container.

In order to grind large areas, the grinding apparatus is designed so that a plurality of grinding units are mounted in the same screen unit. For example, there may be four juxtaposed circular grinding wheels in a grinding unit, whereby a rapid surface grinding of a large surface may be attained. These grinding wheels may be disposed overlapping and displaced, or be juxtaposed.

In an embodiment of the invention, the drive units used for driving the grinding units are motor units that are powered either hydraulically, pneumatically or electrically.

In the preferred embodiment of the invention, the drive unit will be an electric motor which is either provided power via batteries or is connected to the electricity grid.

Since the vacuum from the suction unit is strong, the screen units may, in order to move the grinding apparatus when suspended on a surface, include a damper device for reducing the vacuum in the screen unit, by e.g. allowing the damper device to let false air enter the screen unit.

This damper device will typically be disposed in connection with the pipe connection so that false air is let into the pipe connection whereby the vacuum in the screen unit is reduced. The damper device is adjustable so that the user may adjust the vacuum when moving around with the screen unit.

The grinding apparatus is intended for application to the grinding of surfaces, e.g. the hull of a ship, windmill wings or tower elements. These surfaces may be a mix of plane surfaces and curved surfaces, where it is possible to use either a grinding apparatus with a grinding unit enclosed by a screen unit, or a grinding apparatus with a plurality of grinding units that are enclosed by a number of screen units.

In an embodiment of the invention, a grinding apparatus with a screen unit weighs about 3 kgs and may be used with a usual household suction cleaner with a wattage of 1000-2500 W, and this suction cleaner provides for producing sufficient vacuum (0.5-0.9 bar) for the grinding apparatus to be self-attaching and movable at the same time.

SHORT DESCRIPTION OF THE DRAWING

The invention will now be described further with reference to the accompanying drawing, where:

DETAILED DESCRIPTION OF THE INVENTION

Figure 1:
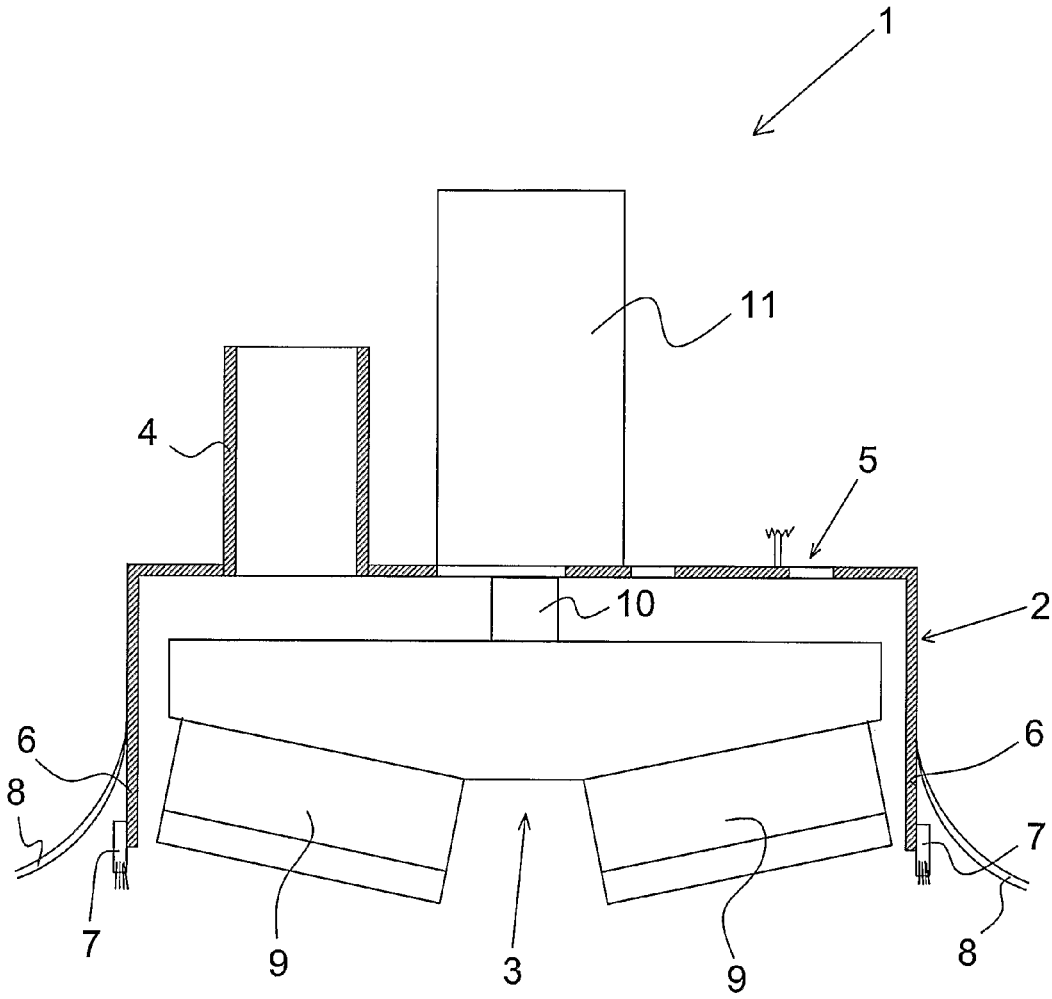
FIG. 1 shows a cross-section of a grinding apparatus according to the invention.

FIG. 1 shows a grinding apparatus 1 including a screen unit 2 which encloses a circular grinding unit 3.

The screen unit 2 comprises:

- a pipe connection 4 arranged for connecting a suction unit (not shown) whereby vacuum is produced internally of the screen unit 2;
- an adjustable damper device 5 for regulating the vacuum internally of the screen unit 2;
- a lower edge 6 designed with adjustable spacer members 7 in the form of brushes and a sealing member 8 in the form of a skirt.

At an underside of the circular grinding unit 3 there is mounted a number of grinding members 9, shown here in the form of abrasive strips of sandpaper, and at a top side of the circular grinding unit 3 it is drivingly connected to a drive unit 11 via a shaft.

Figure 2:
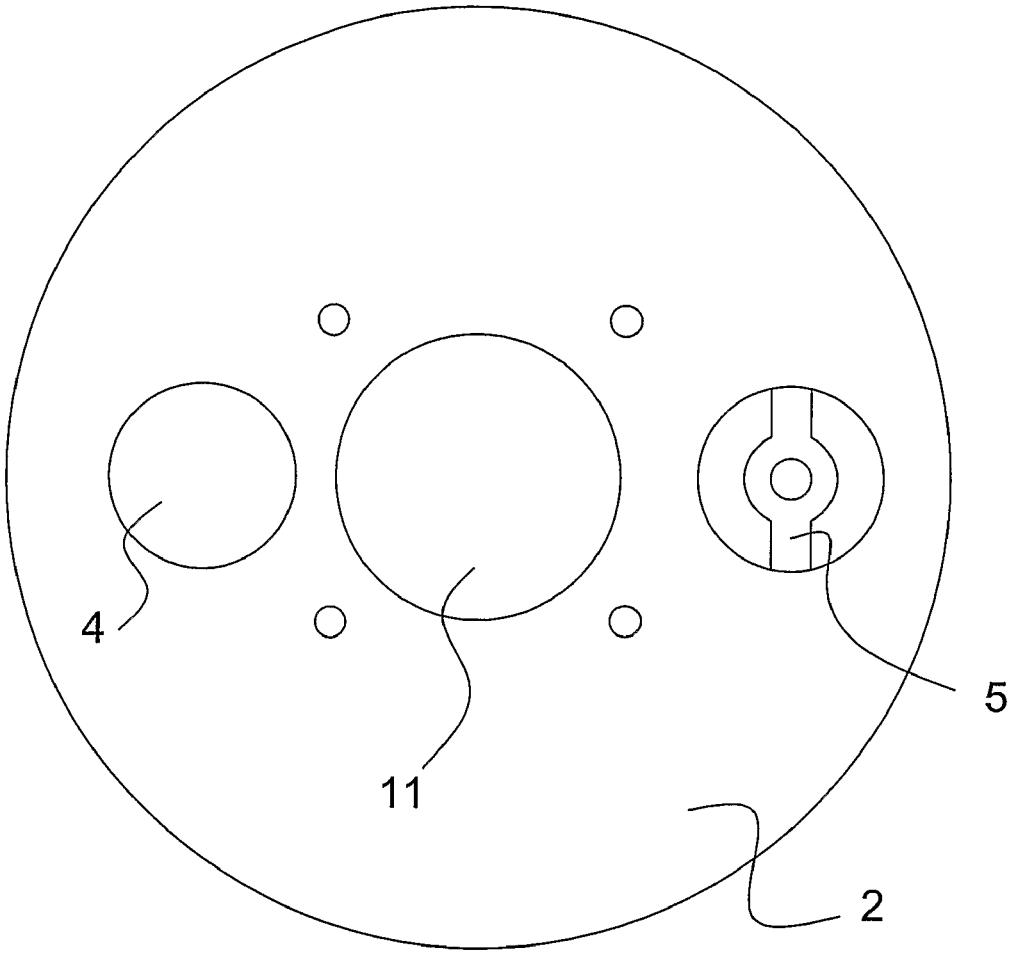
FIG. 2 shows a plane view of a screen unit for a grinding apparatus according to the invention.

FIG. 2 shows a plane view of the screen unit 2 where it is possible to see that it is circular and that it has a pipe connection 4 and a damper device 5 arranged at each side of the centrally disposed drive unit 11.

Figure 3:
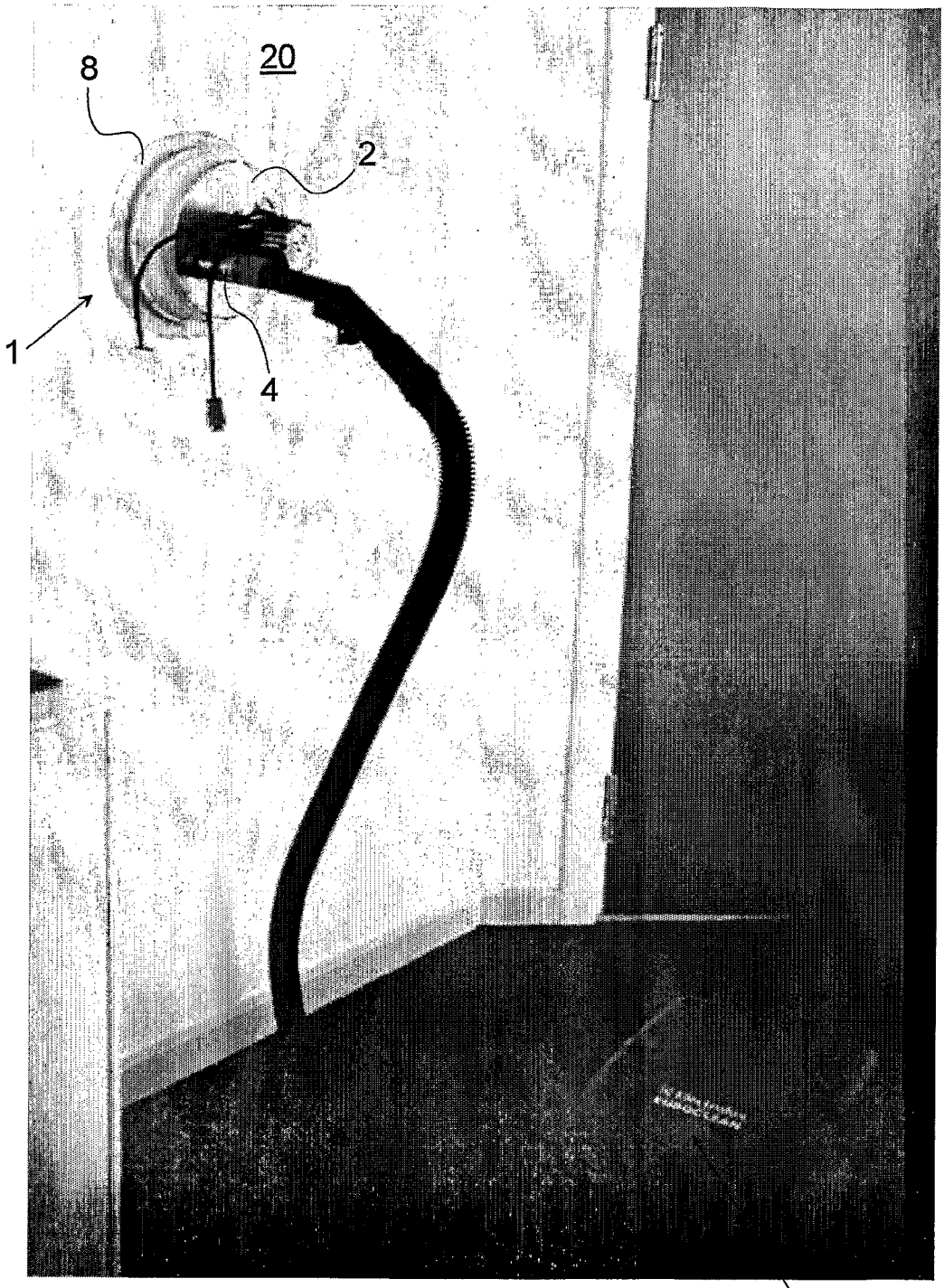
FIG. 3 shows a view of a grinding apparatus on a wall.

FIG. 3 shows a view of a grinding apparatus 1 on a wall 20, where a suction unit 21 in the form of a suction cleaner is connected to the pipe connection 4 on the screen unit 2. The sucking action from the suction unit 21 produces vacuum inside the screen unit 2, where sealing member 8 in the shape of a skirt provides for the screen unit 2 to fit tightly to the wall 20. As it appears, the vacuum from suction unit 21 is powerful enough to make grinding apparatus 1 stay hanging on the wall 20, implying that the grinding apparatus 1 is self-attaching, and force is only required for moving grinding apparatus 1 vertically or horizontally, and not for lifting the grinding apparatus 1.

Figure 4:
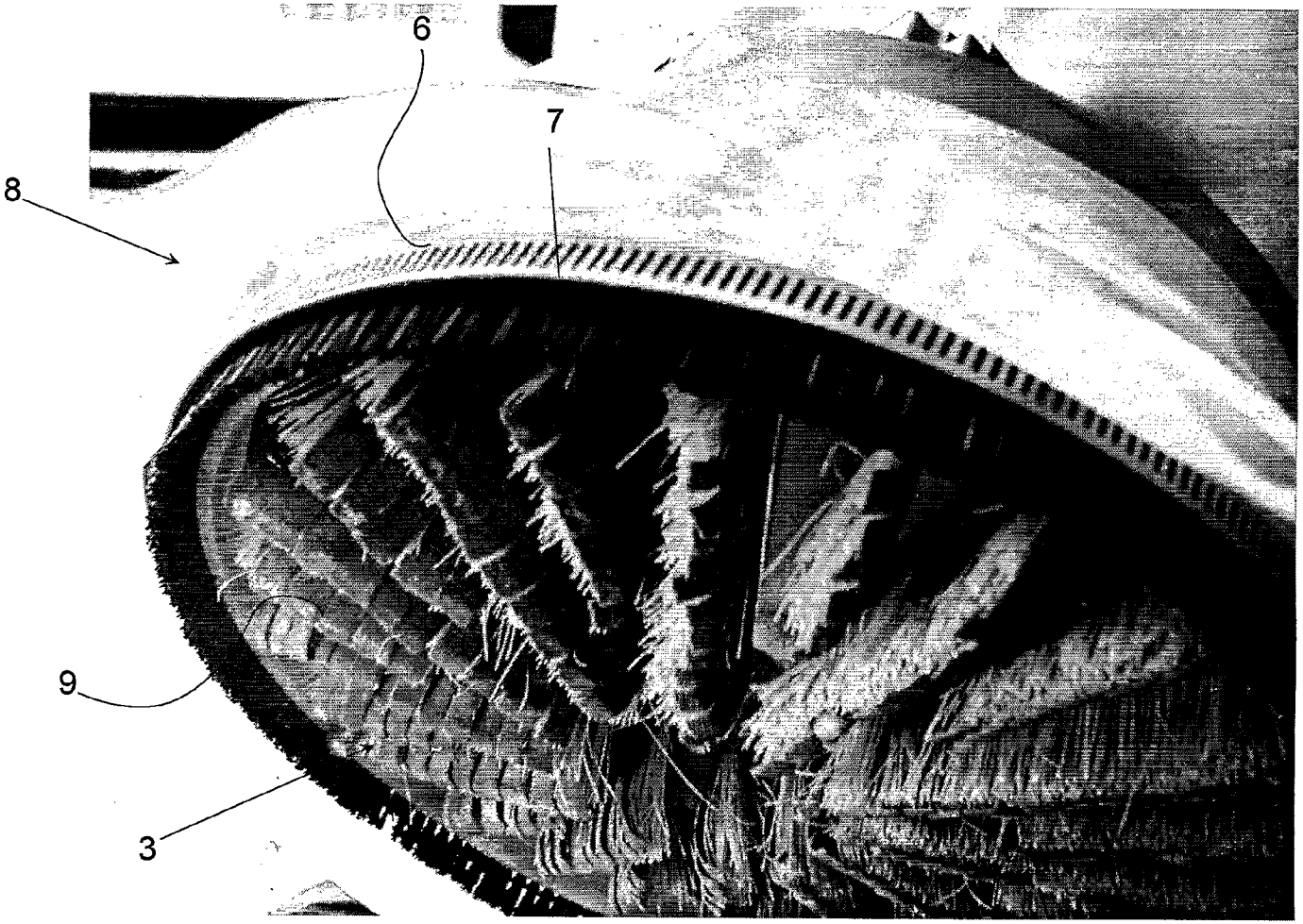
FIG. 4 shows a screen unit for a grinding apparatus according to the invention.

FIG. 4 shows a screen unit 2 where it may be seen that grinding unit 3 is a circular wheel with a number of grinding members 9 in the shape of sandpaper, and that the lower edge 6 of screen unit 2 is connected to spacer members 7 in the form of brushes and which is enclosed by the sealing member 8 in the form of a plastic skirt.

Figure 5:
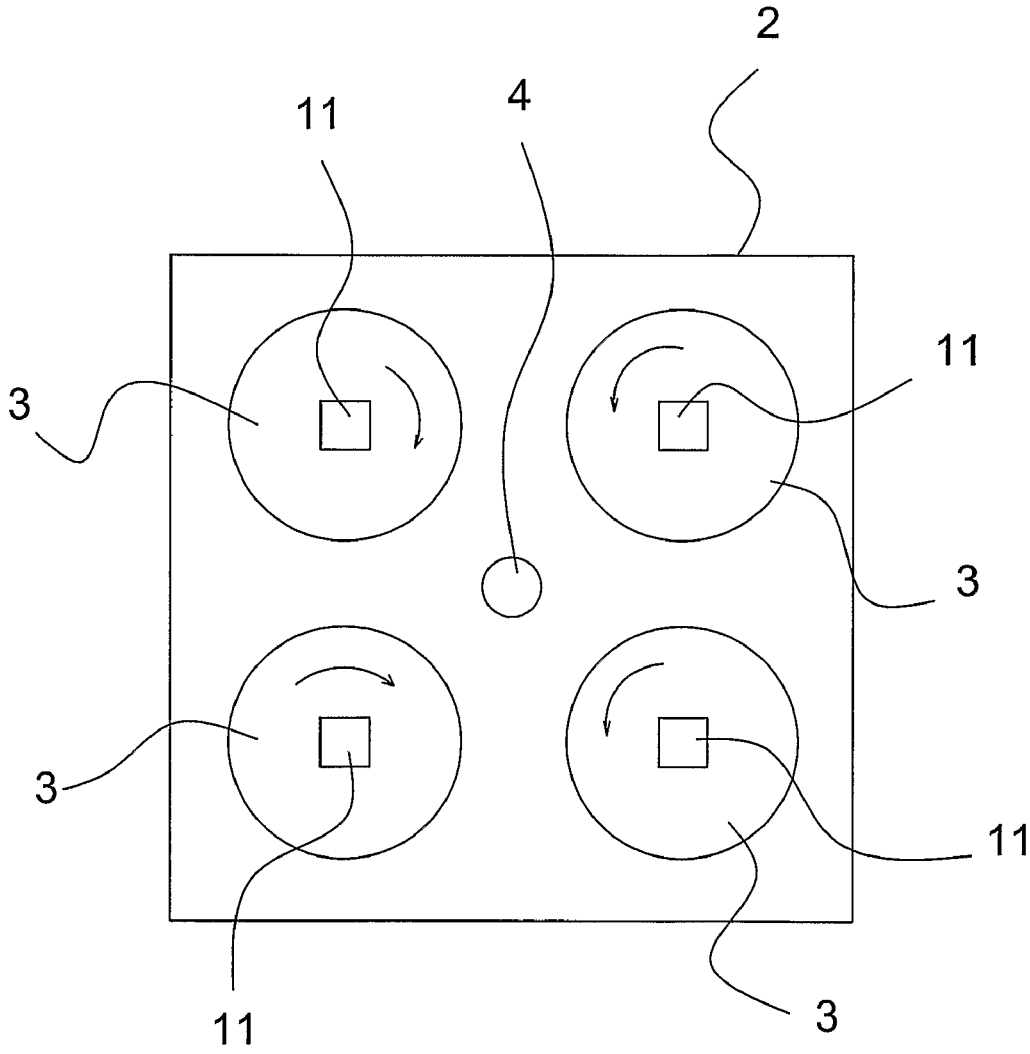
FIG. 5 shows an alternative embodiment of the invention.

FIG. 5 shows an alternative embodiment of the invention where four circular grinding units 3 are surrounded by a screen unit 2 which is provided with a central pipe connection 4 for establishing vacuum inside the vacuum unit 2. Each grinding unit 3 is shown provided with a drive unit 11. This embodiment of the invention may e.g. be used if very large surfaces are to be ground. Furthermore, by controlling the direction of rotation of the grinding units 3, it is possible to control the movement of the screen unit 2.

Figure 6:
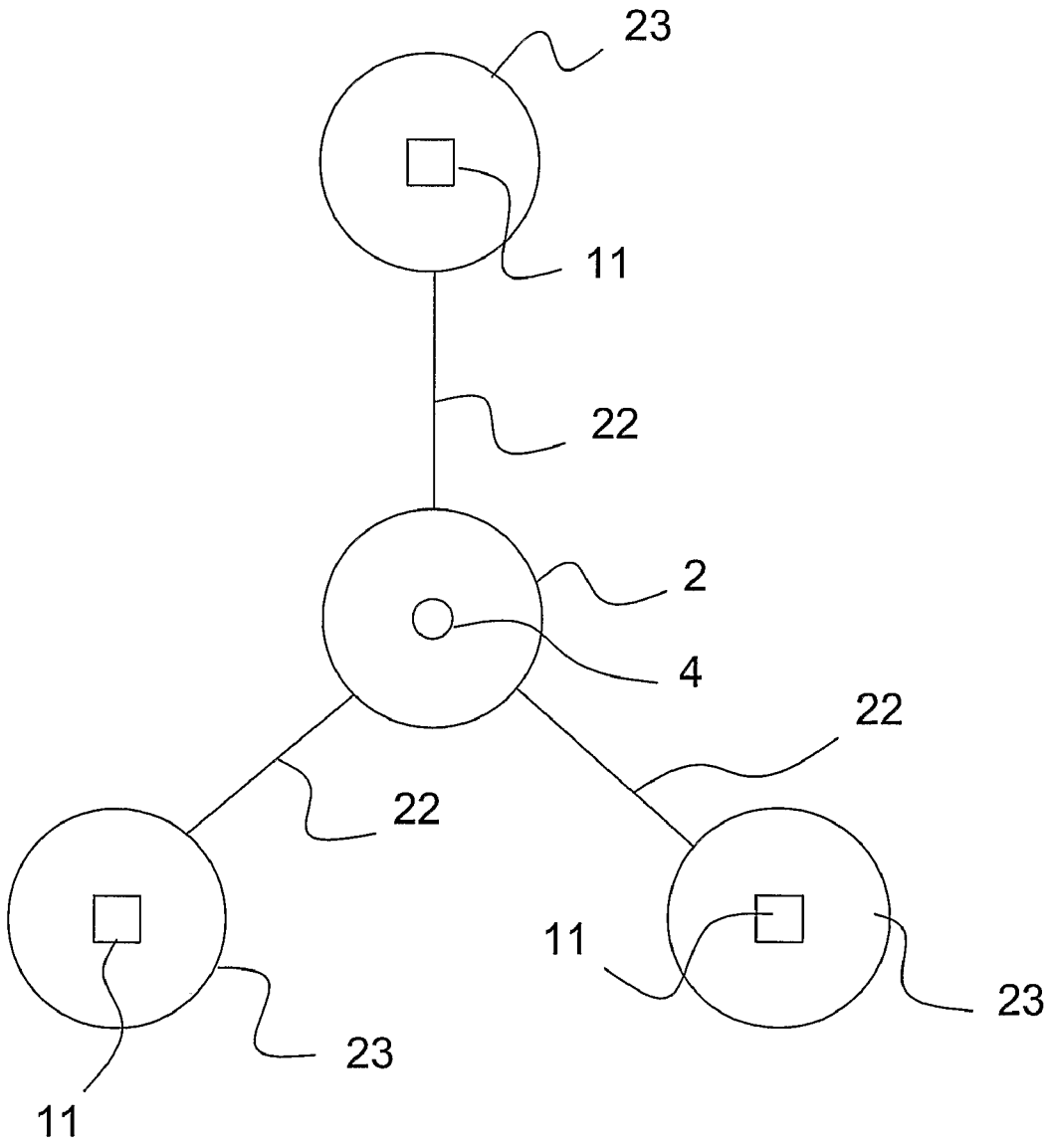
FIG. 6 shows a further alternative embodiment of the invention.

FIG. 6 shows a further alternative embodiment of the invention, where a central screen unit 2 is designed with a pipe connection 4 of connecting a suction unit (not shown) and is articulated connected with linking rods 22 to satellite screen units 23 that each enclose a grinding unit (not shown) which is powered by a drive unit 11.

The invention claimed is:

1. Grinding apparatus (1) including a number of grinding units (3), a number of drive units (11) and a number of screen units (2), where a number of the grinding units (3) are enclosed by at least one of the screen units (2), and where at least one of the screen units (2) is arranged with a pipe connection (4) adapted for connecting one or more suction units (21), characterised in that the screen unit (2) with the pipe connection (4) is designed along a lower edge (6) with a number of spacer members (7) that are arranged adjustable and replaceable, and with a number of sealing members (8) that fit tightly to an underlying surface, that the spacer members (7) establish an spacing adjustment of the grinding units (3) relatively to an underlying surface, and that the sealing members (8) interact with the suction units (21) for forming a vacuum that holds the grinding apparatus (1) against the said surface during operation.

2. Grinding apparatus (1) according to claim 1, characterised in that the screen unit (2) with the pipe connection (4) encloses a number of the grinding units (3).

3. Grinding apparatus (1) according to claim 1, characterised in that the screen unit (2) with the pipe connection (4) is connected with satellite screen units (23) that each encloses a number of the grinding units (3).

4. Grinding unit (1) according to claim 1, characterised in that each of the screen units (2, 23) include a number of wheels.

5. Grinding unit (1) according to claim 1, characterised in that the screen units (2, 23) articulated connected with a number of linking rods (22).

6. Grinding unit (1) according to claim 1, characterised in that the screen units (2, 23) include two screens that are arranged preferably coaxially.

7. Grinding unit (1) according to claim 1, characterised in that at least one of the screen units (2) is connected with a longitudinally adjustable handle.

8. Grinding unit (1) according to claim 1, characterised in that the grinding units (3) are shaped as circular grinding heads, cylindric grinding rollers and/or polygonal grinding plates.

9. Grinding unit (1) according to claim 1, characterised in that the screen units (3) are replaceable and height adjustable.

10. Grinding unit (1) according to claim 1, characterised in that the suction units (21) are vacuum pumps, suction cleaners and/or fans.

11. Grinding unit (1) according to claim 1, characterised in that the screen units (2, 23) include a damper device for reducing vacuum in the screen unit (2, 23).

* * * * *